US006704701B1

(12) United States Patent
Gao

(10) Patent No.: US 6,704,701 B1
(45) Date of Patent: Mar. 9, 2004

(54) BI-DIRECTIONAL PITCH ENHANCEMENT IN SPEECH CODING SYSTEMS

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 0 days.

(21) Appl. No.: 09/365,444

(22) Filed: Aug. 2, 1999

Related U.S. Application Data

(60) Provisional application No. 60/142,092, filed on Jul. 2, 1999.

(51) Int. Cl.[7] ..... G10L 11/04; G10L 19/04; G10L 19/10

(52) U.S. Cl. ..... 704/207; 704/219

(58) Field of Search ..... 704/201, 206, 704/207, 212, 219, 220, 221, 223

(56) References Cited

U.S. PATENT DOCUMENTS

| | | | | | |
|---|---|---|---|---|---|
| 5,528,727 | A | * | 6/1996 | Wang | 704/223 |
| 5,774,837 | A | * | 6/1998 | Yeldener et al. | 704/219 |
| 5,890,108 | A | * | 3/1999 | Yeldener | 704/219 |
| 5,899,967 | A | * | 5/1999 | Nagasaki | 704/208 |
| 6,161,086 | A | * | 12/2000 | Mukherjee et al. | 704/219 |
| 6,240,386 | B1 | * | 5/2001 | Thyssen et al. | 704/220 |
| 6,385,576 | B2 | * | 5/2002 | Amada et al. | 704/223 |
| 6,556,966 | B1 | * | 4/2003 | Gao | 704/220 |
| 6,574,593 | B1 | * | 6/2003 | Gao et al. | 704/222 |
| 6,581,032 | B1 | * | 6/2003 | Gao et al. | 704/222 |
| 6,604,070 | B1 | * | 8/2003 | Gao et al. | 704/222 |

OTHER PUBLICATIONS

Yang et al., "Voiced speech coding at very low bit rates based on forward–backward waveform prediction," IEEE Transactions on Speech and Audio Processing, Jan. 1995, vol. 3, pp. 40 to 47.*

Pettigrew et al., "Backward pitch prediction for low–delay speech coding," IEEE Global Telecommunications Conference, 1989, and Exhibition. Communications Technology for the 1990s and Beyond, Nov. 1989, vol. 2, pp. 1247 to 1252.*

V. Cuperman, "Low delay speech coding," 1991 Conference Record of the Twenty–Fifth Asilomar Conference on Signals, Systems and Computers, Nov. 1991, vol. 2, pp. 935 to 939.*

International Telecommunication Union (Telecommunication Standardization Sector of ITU), "General Aspects of Digital Transmission System. Coding of Speech at 8 kbit/s Using Conjugate–Structure Algebraic–Code–Excited Linear–Prediction (CS–ACELP)," ITU–T Recommendation G.729, pp. 1–35, 1996.

* cited by examiner

*Primary Examiner*—Richemond Dorvil
*Assistant Examiner*—Martin Lerner
(74) *Attorney, Agent, or Firm*—Farjami & Farjami LLP

(57) ABSTRACT

A bi-directional pitch enhancement system for speech coding systems. As speech data applications continue to operate in areas having intrinsic bandwidth limitations, the perceptual quality of reproduced speech data in typical speech coding systems suffers significantly. The present invention employs forward pitch enhancement and backward pitch enhancement to maintain a high perceptual quality in reproduced speech. In certain embodiments of the invention, the forward pitch enhancement and the backward pitch enhancement are performed in a single portion of the entire speech coding system. For example, in speech codecs, the forward and the backward pitch enhancement are performed only in the speech codec's encoder, or alternatively, only in the speech codec's decoder. If desired, the forward and the backward pitch enhancement are performed in a distributed manner, each being performed, at least in part, in each one of the encoder and the decoder of the speech codec. If desired, the backward pitch enhancement is generated using the forward pitch enhancement itself. The backward pitch enhancement is a mirror image of the forward pitch enhancement that is previously generated; the backward pitch enhancement is generated dependent on the forward pitch enhancement. Alternatively, in other embodiments of the invention, the backward pitch enhancement is generated independent of the forward pitch enhancement; the backward pitch enhancement is generated irrespective of the forward pitch enhancement that has previously been generated. The backward pitch enhancement is usually performed on the fixed codebook in code excited linear prediction (CELP) or is performed as post-processing in the decoder.

23 Claims, 7 Drawing Sheets

BI-DIRECTIONAL PITCH ENHANCEMENT IN SPEECH CODING SYSTEMS

CROSS-REFERENCE TO RELATED APPLICATIONS

The present application is based on U.S. Provisional Application Ser. No. 60/142,092, filed Jul. 2, 1999.

BACKGROUND

1. Technical Field

The present invention relates generally to speech coding; and, more particularly, it relates to low bit rate speech coding systems that employ pitch enhancement to improve the perceptual quality of reproduced speech.

2. Description of Related Art

Conventional speech coding systems typically employ only forward pitch enhancement in code-excited linear prediction speech coding systems. This is largely due to the fact that the sub-frame size of conventional speech codecs, having relatively large bandwidth availability, can provide sufficient perceptual quality with forward pitch enhancement alone. However, for lower bit rates within various communication media employed in speech coding systems, the perceptual quality of reproduced speech, after synthesis, fails to maintain a high perceptual quality.

For conventional speech coding systems that operate at these decreased bit rates, the pitch lag, that is generated during pitch prediction, is commonly much shorter than the overall subframe size, i.e., it covers a relatively small portion of the overall sub-frame. This characteristic is more accentuated for those speakers having a higher (shorter) pitch, such as females and children. Traditional excitation codebook structures do not afford a sufficient high perceptual quality when operating at low bit rates. This is primarily because the periodicity of the voiced signal is not sufficiently established, or the excitation vector extracted from the codebook is insufficiently rich to generate a synthesized speech signal having a high perceptual quality.

As the sub-frame size of speech coding systems becomes larger, as is commonly associated with communication systems that have decreasing bit rates, the fact that pitch enhancement is performed in only the forward direction results in significantly poorer perceptual quality. This is due, among other reasons, to the fact that there is a significant amount of dead space in the sub-frame due to the absence of many pulses. In conventional speech coding systems that operate at higher bit rate, having consequently shorter sub-frames, this effect is not typically audibly perceived by the human ear. This effect of lower perceptual quality is realized in nearly all speech coding systems that deal with speech coding having relatively low available bit rates.

Further limitations and disadvantages of conventional and traditional systems will become apparent to one of skill in the art through comparison of such systems with the present invention as set forth in the remainder of the present application with reference to the drawings.

SUMMARY OF THE INVENTION

Various aspects of the present invention can be found in a speech coding system that employs forward pitch enhancement and backward pitch enhancement. In certain embodiments of the invention, the forward pitch enhancement and the backward pitch enhancement are performed in a single portion of the entire speech coding system. For example, in speech coding systems having a speech codec, wherein the speech codec contains an encoder and a decoder, the forward pitch enhancement and the backward pitch enhancement are performed in both the encoder and the decoder of the speech codec. Alternatively, in other embodiments of the invention, the forward pitch enhancement and the backward pitch enhancement are performed only in the decoder of the speech codec. As determined by the specific application, the forward pitch enhancement and the backward pitch enhancement are performed in a distributed manner, each being performed, at least in part, in each one of the encoder and the decoder of the speech codec.

In certain embodiments of the invention, the backward pitch enhancement is generated using the forward pitch enhancement itself. The backward pitch enhancement is a mirror image of the forward pitch enhancement that is previously generated; the backward pitch enhancement is generated dependent on the forward pitch enhancement. Alternatively, in other embodiments of the invention, the backward pitch enhancement is generated independent of the forward pitch enhancement; the backward pitch enhancement is generated irrespective of the forward pitch enhancement that has previously been generated.

The speech coding system, built in accordance with the present invention, is appropriately geared toward those speech coding systems that operate using communication media having limited or constrained bandwidth availability. Any communication media may be employed within in the invention, without departing from the scope and spirit thereof. Examples of such communication media include, but are not limited to, wireless communication media, wire-based telephonic communication media, fiber-optic communication media, and ethernet.

Other aspects, advantages and novel features of the present invention will become apparent from the following detailed description of the invention when considered in conjunction with the accompanying drawings.

DETAILED DESCRIPTION OF DRAWINGS

Figure 1:
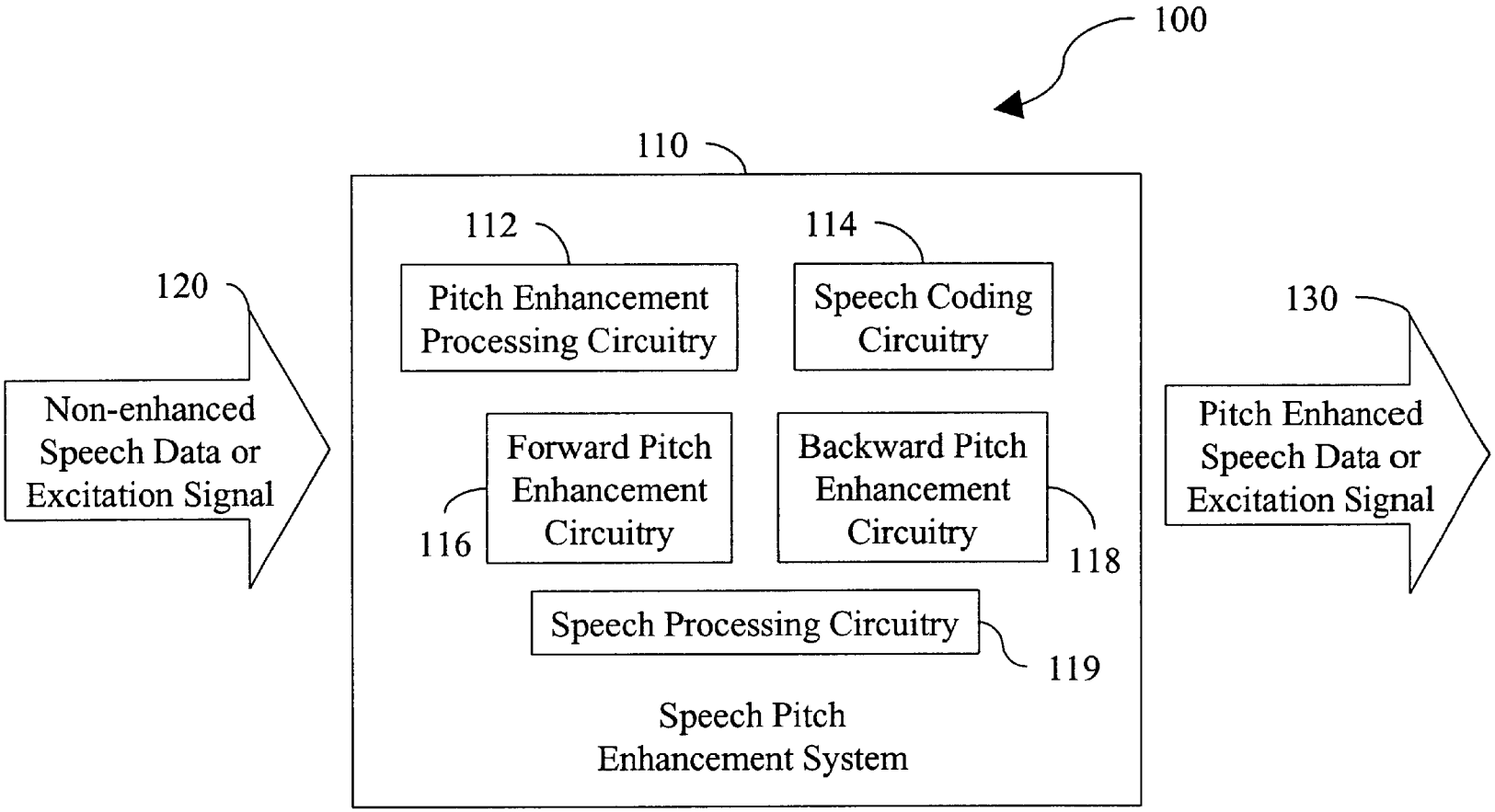
FIG. 1 is a system diagram illustrating one embodiment of a speech pitch enhancement system built in accordance with the present invention.

FIG. 1 is a system diagram illustrating one embodiment 100 of a speech pitch enhancement system 110 built in accordance with the present invention. The speech pitch enhancement system 110 contains, among other things, pitch enhancement processing circuitry 112, speech coding circuitry 114, forward pitch enhancement circuitry 116, backward pitch enhancement circuitry 118, and speech processing circuitry 119. The speech pitch enhancement system 110 operates on non-enhanced speech data or excitation signal 120 and generates pitch enhanced speech data 130. The pitch enhanced speech data or excitation signal 130 contains speech data having pitch prediction and pitch enhancement performed in both the forward and backward directions with respect to a speech sub-frame. The speech pitch enhancement system 110 operates only on an excitation signal in certain embodiments of the invention, and the speech pitch enhancement system 110 operates only on speech data in other embodiments of the invention.

In certain embodiments of the invention, the speech pitch enhancement system 110 operates independently to generate backward pitch prediction using the backward pitch enhancement circuitry 118. Alternatively, the forward pitch enhancement circuitry 116 and the backward pitch enhancement circuitry 118 operate cooperatively to generate the overall pitch enhancement of the speech coding system. A supervisory control operation, monitoring the forward pitch enhancement circuitry 116 and the backward pitch enhancement circuitry 118, is performed using the pitch enhancement processing circuitry 112 in other embodiments of the invention. The speech processing circuitry 119 includes, but is not limited to, that speech processing circuitry known to those having skill in the art of speech processing to operate on and perform manipulation of speech data. The speech coding circuitry 114 similarly includes, but is not limited to, circuitry known to those of skill in the art of speech coding. Such speech coding known to those having skill in the art includes, among other speech coding methods, code-excited linear prediction, algebraic code-excited linear prediction, and pulse-like excitation.

Figure 2:
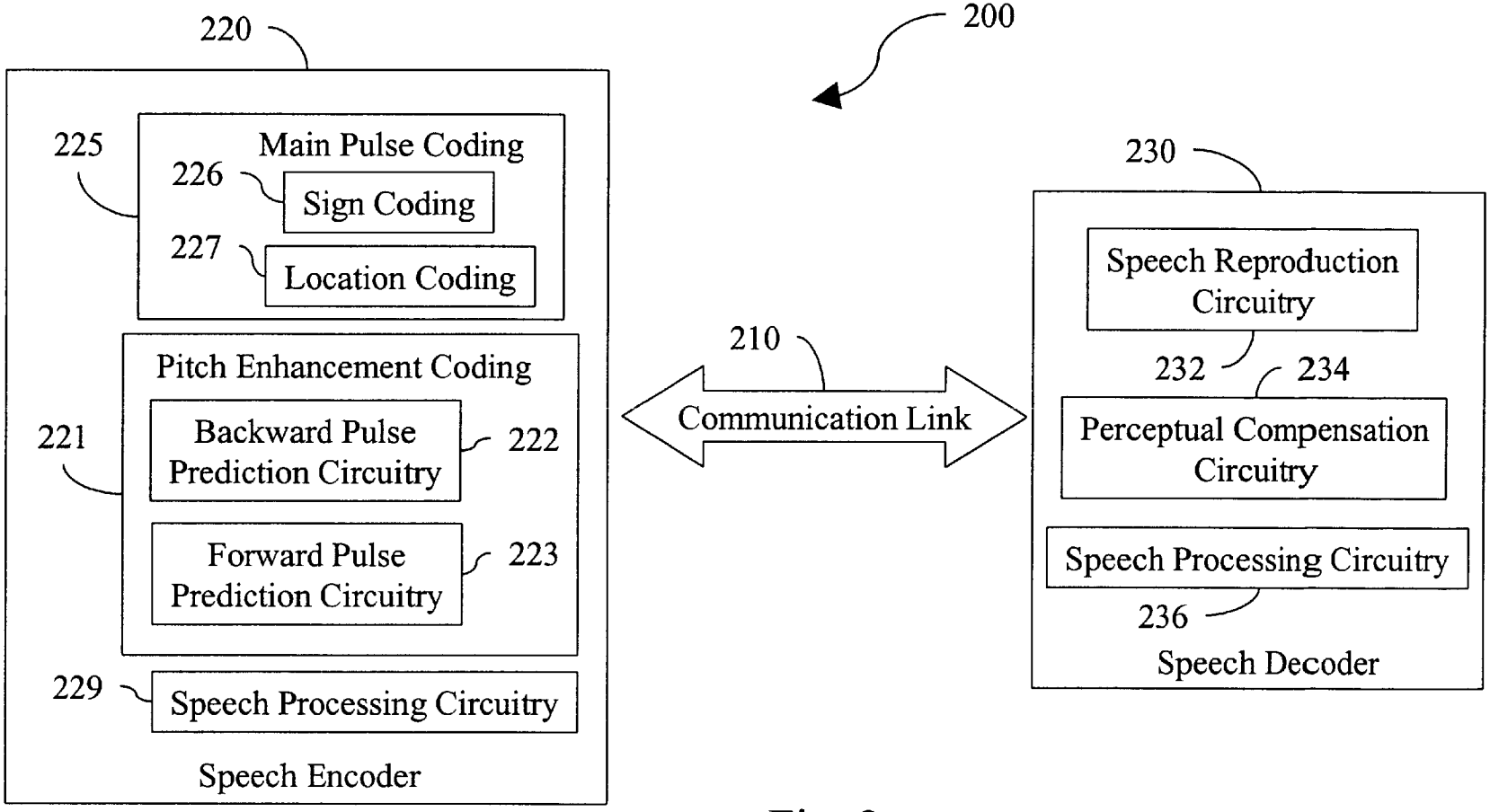
FIG. 2 is a system diagram illustrating one embodiment of a distributed speech codec that employs speech pitch enhancement in accordance with the present invention.

FIG. 2 is a system diagram illustrating one embodiment of a distributed speech codec 200 that employs speech pitch enhancement in accordance with the present invention. A speech encoder 220 of the distributed speech codec 200 performs pitch enhancement coding 221. The pitch enhancement coding 221 is performed using both backward pulse pitch prediction circuitry 222 and forward pulse pitch prediction circuitry 223. As described above in another embodiment of the invention, the pitch enhancement coding 221 generates pitch prediction and pitch enhancement in both the forward and backward directions within the speech sub-frame. The speech encoder 220 of the distributed speech codec 200 also performs main pulse coding 225 of a speech signal including both sign coding 226 and location coding 227 within a speech sub-frame. Speech processing circuitry 229 is also employed within the speech encoder 220 of the distributed speech codec 200 to assist in speech processing using methods known to those having skill in the art of speech processing to operate on and perform manipulation of speech data. Additionally, the speech processing circuitry 229 operates cooperatively with the backward pulse pitch prediction circuitry 222 and forward pulse pitch prediction circuitry 223 in certain embodiments of the invention. The speech data, after having been processed, at least to some extent by the speech encoder 220 of the distributed speech codec 200 is transmitted via a communication link 210 to a speech decoder 230 of the distributed speech codec 200. The communication link 210 is any communication media capable of transmitting voiced data, including but not limited to, wireless communication media, wire-based telephonic communication media, fiber-optic communication media, and ethernet. Any communication media capable of transmitting speech data is included in the communication link 210 without departing from the scope and spirit of the invention. The speech decoder 230 of the distributed speech codec 200 contains, among other things, speech reproduction circuitry 232, perceptual compensation circuitry 234, and speech processing circuitry 236.

In certain embodiments of the invention, the speech processing circuitry 229 and the speech processing circuitry 236 operate cooperatively on the speech data within the entirety of the distributed speech codec 200. Alternatively, the speech processing circuitry 229 and the speech processing circuitry 236 operate independently on the speech data, each serving individual speech processing functions in the speech encoder 220 and the speech decoder 230, respectively. The speech processing circuitry 229 and the speech processing circuitry 236 include, but are not limited to, that speech processing circuitry known to those having skill in the art of speech processing to operate on and perform manipulation of speech data. The main pulse coding circuitry 225 similarly includes, but is not limited to, circuitry known to those of skill in the art of speech coding. Examples of such main pulse coding circuitry 225 include that circuitry known to those having skill in the art, among other main pulse coding methods, code-excited linear prediction, algebraic code-excited linear prediction, and pulse-like excitation, as described above in another embodiment of the invention.

Figure 3:
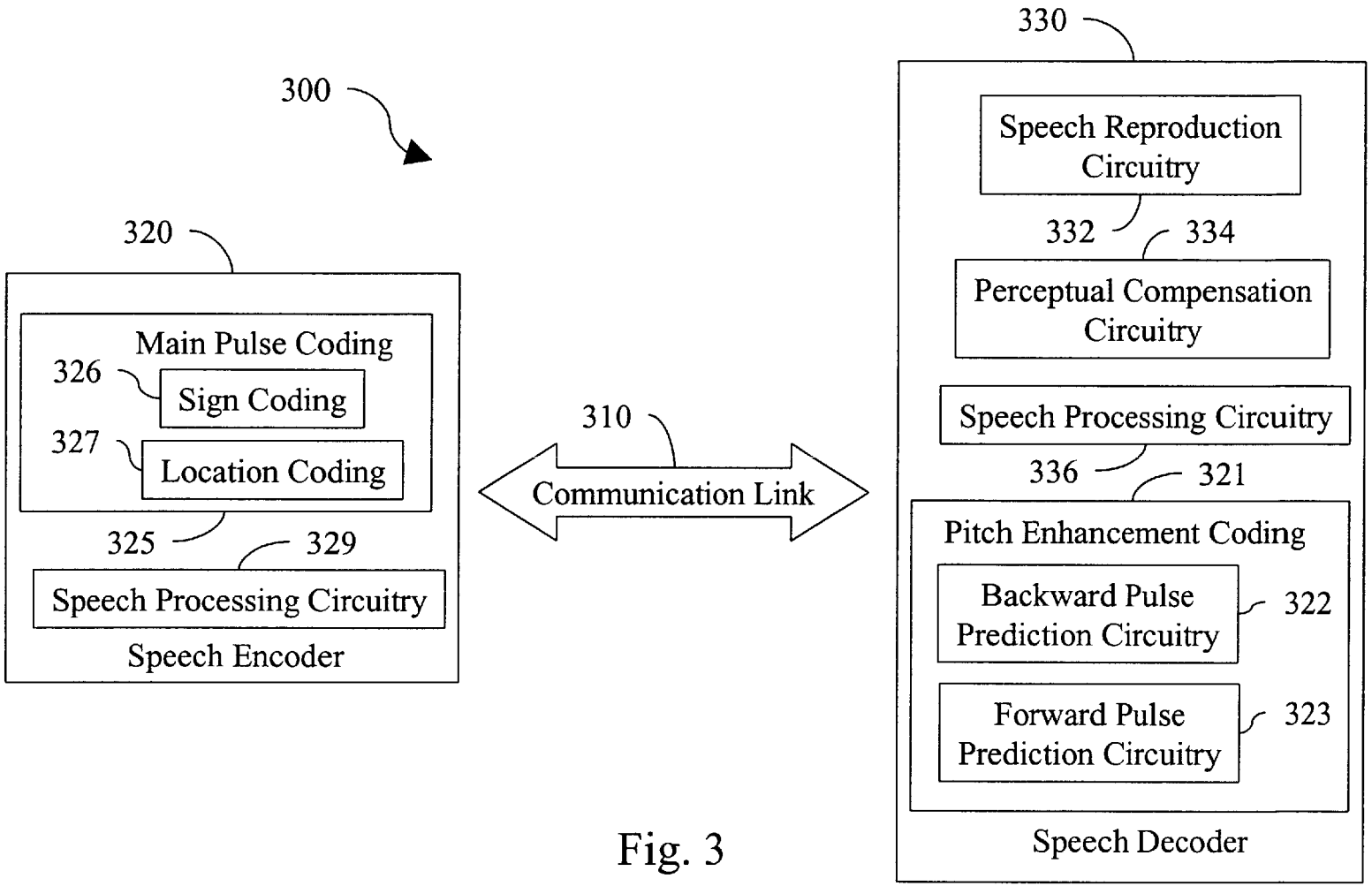
FIG. 3 is a system diagram illustrating another embodiment of a distributed speech codec that employs speech pitch enhancement in accordance with the present invention.

FIG. 3 is a system diagram illustrating another embodiment of a distributed speech codec 300 that employs speech pitch enhancement in accordance with the present invention. A speech encoder 320 of the distributed speech codec 300 performs main pulse coding 325 of a speech signal including both sign coding 326 and location coding 327 within a speech sub-frame. Speech processing circuitry 329 is also employed within the speech encoder 320 of the distributed speech codec 300 to assist in speech processing using methods known to those having skill in the art of speech processing to operate on and perform manipulation of speech data. The speech data, after having been processed, at least to some extent by the speech encoder 320 of the distributed speech codec 300 is transmitted via a communication link 310 to a speech decoder 330 of the distributed speech codec 300. The communication link 310 is any communication media capable of transmitted voiced data, including but not limited to, wireless communication media, wire-based telephonic communication media, fiber-optic communication media, and ethernet. Any communication media capable of transmitting speech data is included in the communication link 310 without departing from the scope and spirit of the invention. A speech decoder 330 of the distributed speech codec 300 performs pitch enhancement coding 321. The pitch enhancement coding 321 is performed using both backward pulse pitch prediction circuitry 322 and forward pulse pitch prediction circuitry 323. As described above in various embodiments of the invention, the pitch enhancement coding 321 generates pitch prediction and pitch enhancement in both the forward and backward directions within the speech sub-frame. Speech processing circuitry 336 is also employed within the speech decoder 330 of the distributed speech codec 300 to assist in speech processing using methods known to those having skill in the art of speech processing to operate on and perform manipulation of speech data. Additionally, the speech processing circuitry 339 operates cooperatively with the backward pulse pitch prediction circuitry 322 and forward pulse pitch prediction circuitry 323 in certain embodiments of the invention.

In certain embodiments of the invention, the speech processing circuitry 329 and the speech processing circuitry 336 operate cooperatively on the speech data within the entirety of the distributed speech codec 300. Alternatively, the speech processing circuitry 329 and the speech processing circuitry 336 operate independently on the speech data, each serving individual speech processing functions in the speech encoder 320 and the speech decoder 330; respectively. The speech processing circuitry 329 and the speech processing circuitry 336 include, but are not limited to, that speech processing circuitry known to those having skill in the art of speech processing to operate on and perform manipulation of speech data. The main pulse coding circuitry 325 similarly includes, but is not limited to, circuitry known to those of skill in the art of speech coding. Examples of such main pulse coding circuitry 325 includes that circuitry known to those having skill in the art, among other main pulse coding methods, code-excited linear prediction, algebraic code-excited linear prediction, and pulse-like excitation, as described above in another embodiment of the invention.

Figure 4:
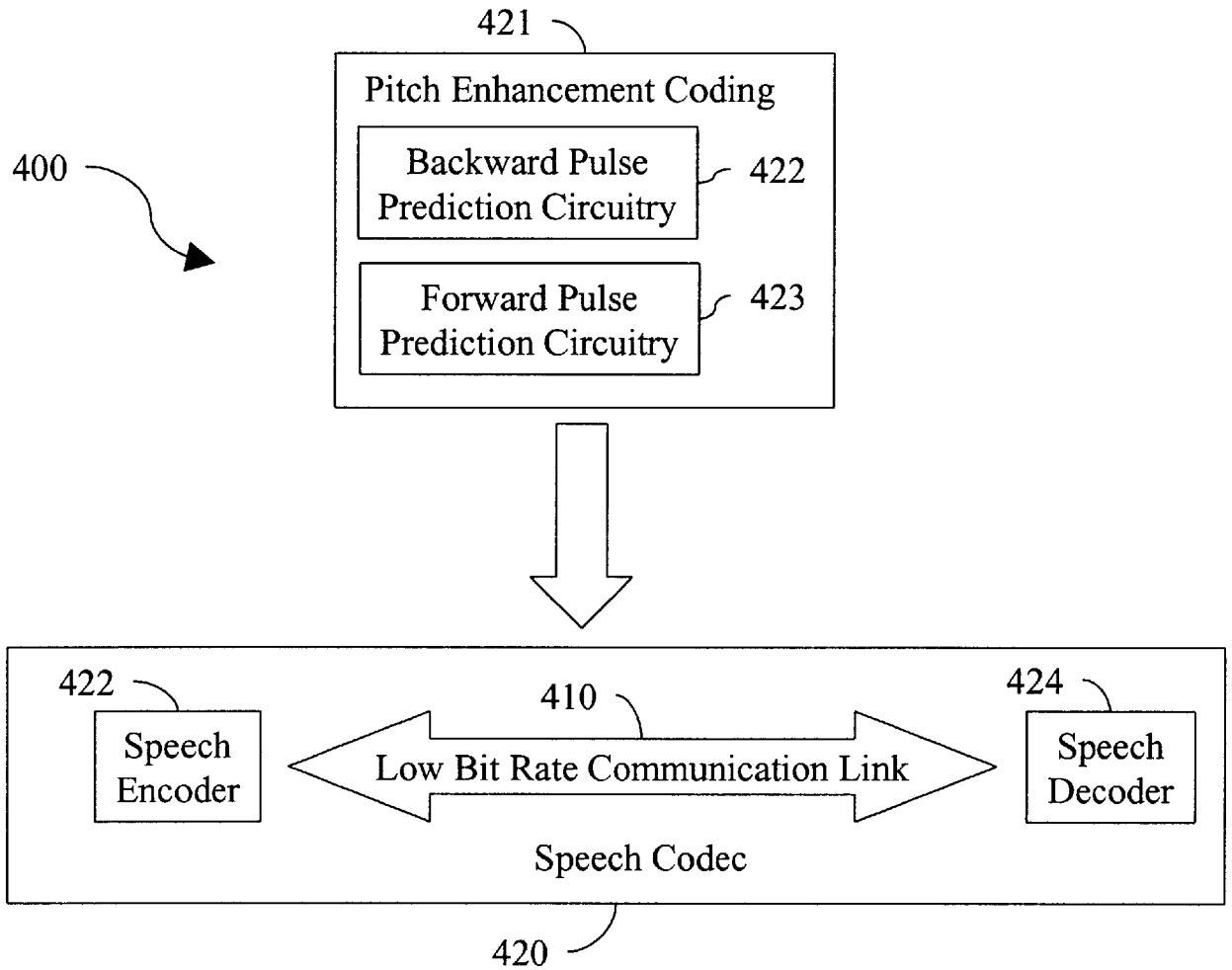
FIG. 4 is a system diagram illustrating another embodiment of an integrated speech codec that employs speech pitch enhancement in accordance with the present invention.

FIG. 4 is a system diagram illustrating another embodiment 400 of an integrated speech codec 420 that employs speech pitch enhancement in accordance with the present invention. The integrated speech codec 420 contains, among other things, a speech encoder 422 that communicates with a speech decoder 424 via a low bit rate communication link 410. The low bit rate communication link 410 is any communication media capable of transmitting voiced data, including but not limited to, wireless communication media, wire-based telephonic communication media, fiber-optic communication media, and ethernet. Any communication media capable of transmitting speech data is included in the low bit rate communication link 410 without departing from the scope and spirit of the invention. Pitch enhancement coding 421 is performed in the integrated speech codec 420. The pitch enhancement coding 421 is performed using, among other things, backward pulse pitch prediction circuitry 422 and forward pulse pitch prediction circuitry 423. As described above in various embodiments of the invention, the backward pulse pitch prediction circuitry 422 and the forward pulse pitch prediction circuitry 423 operate cooperatively in certain embodiments of the invention, and independently in other embodiments of the invention.

As shown in the embodiment 400, the backward pulse pitch prediction circuitry 422 and the forward pulse pitch prediction circuitry 423 are contained within the entirety of the integrated speech codec 420. If desired, the backward pulse pitch prediction circuitry 422 and the forward pulse pitch prediction circuitry 423 are both contained in each of the speech encoder 422 and the speech decoder 424 in certain embodiments of the invention. Alternatively, either one of the backward pulse pitch prediction circuitry 422 or the forward pulse pitch prediction circuitry 423 is contained in only one of the speech encoder 422 and the speech decoder 424 in other embodiments of the invention. Depending on the specific application at hand, a user can select to place the backward pulse pitch prediction circuitry 422 and the forward pulse pitch prediction circuitry 423 in only one or either of the speech encoder 422 and the speech decoder 424. Various embodiments are envisioned in the invention, without departing from the scope and spirit thereof, to place various amounts of the backward pulse pitch prediction circuitry 422 and the forward pulse pitch prediction circuitry 423 in the speech encoder 422 and the speech decoder 424. For example, a predetermined portion of the backward pulse pitch prediction circuity 422 is placed in the speech encoder 422 while a remaining portion of the backward pulse pitch prediction circuitry 422 is placed in the speech decoder 424 in certain embodiments of the invention. Similarly, a predetermined portion of the forward pulse pitch prediction circuitry 423 is placed in the speech encoder 422 while a remaining portion of the forward pulse pitch prediction circuitry 423 is placed in the speech decoder 424 in certain embodiments of the invention.

Figure 5:
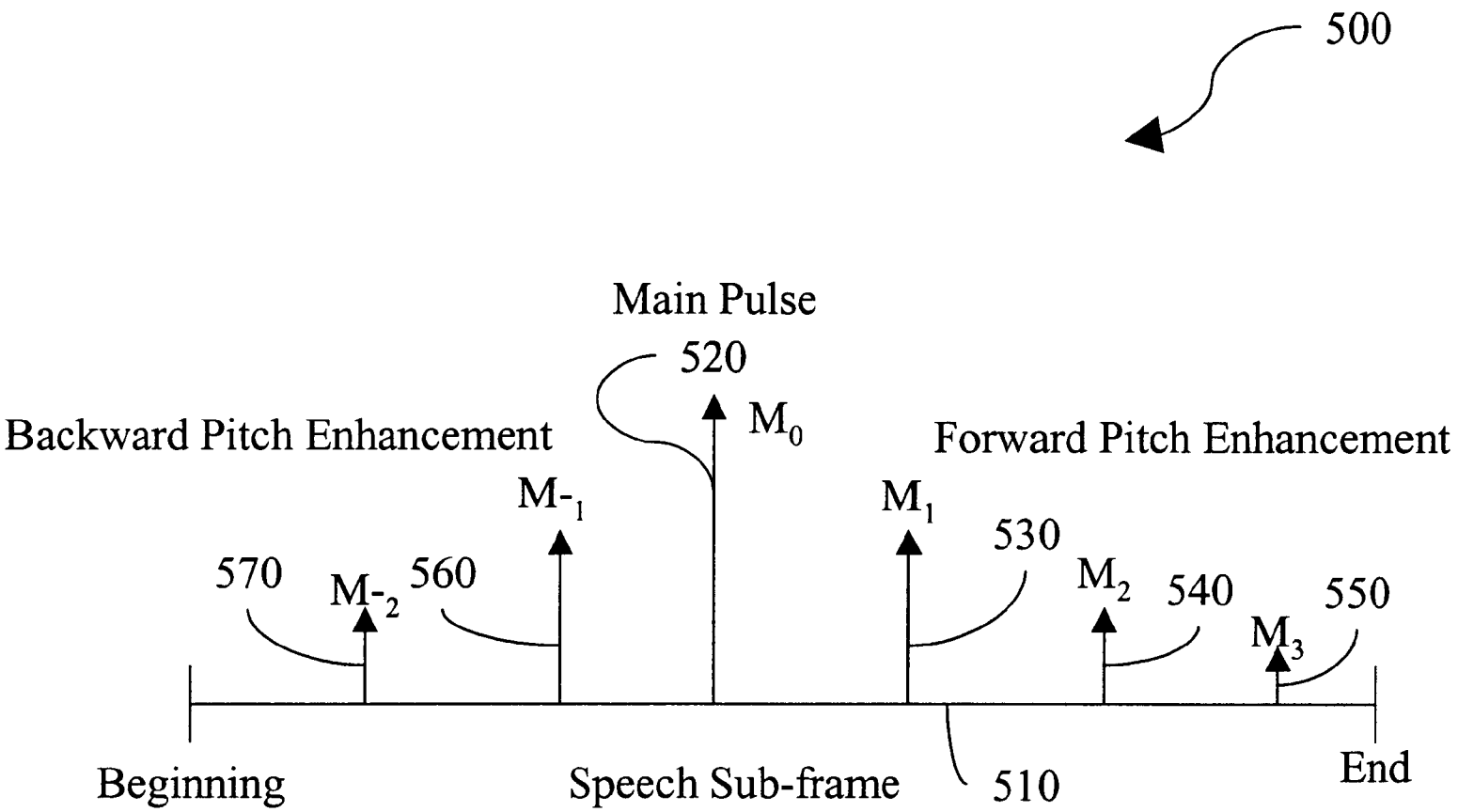
FIG. 5 is a diagram illustrating a speech sub-frame depicting forward and backward predicted pulses to perform pitch enhancement in accordance with the present invention.

FIG. 5 is a coding diagram 500 illustrating a speech sub-frame 510 depicting forward pitch enhancement and backward pitch enhancement performed in accordance with the present invention. A main pulse $M_0$ 520 is generated in the speech sub-frame 510 using any method known to those having skill in the art of speech processing, including but not limited to, code-excited linear prediction, algebraic code-excited linear prediction, analysis by synthesis speech coding, and pulse-like excitation. Using various methods of speech processing, including those methods described above that are employed in various embodiments of the invention, a forward predicted pulse $M_1$ 530, a forward predicted pulse $M_2$ 540, and a forward predicted pulse $M_3$ 550 are all generated and placed within the speech sub-frame 510. As described above, the generation of the forward predicted pulse $M_1$ 530, the forward predicted pulse $M_2$ 540, and the forward predicted pulse $M_3$ 550 is performed using various processing circuitry in certain embodiments of the invention. In addition, a backward predicted pulse $M_{-1}$ 560 and a backward predicted pulse $M_{-2}$ 570 are also generated in accordance with the invention.

In certain embodiments of the invention, the backward predicted pulse $M_{-1}$ 560 and the backward predicted pulse $M_{-2}$ 570 are generated using the forward predicted pulse $M_1$ 530, the forward predicted pulse $M_2$ 540, and the forward predicted pulse $M_3$ 550. Alternatively, in other embodiments of the invention, the backward predicted pulse $M_{-1}$ 560 and the backward predicted pulse $M_{-2}$ 570 are generated independent of the forward predicted pulse $M_1$ 530, the forward predicted pulse $M_2$ 540, and the forward predicted pulse $M_3$ 550. An example of independent generation of the backward predicted pulse $M_{-1}$ 560 and the backward predicted pulse $M_{-2}$ 570 is an implementation within software wherein the time scale of the speech sub-frame 510 is reversed in software. The main pulse $M_0$ 520 is used in a similar manner to generate both the forward predicted pulse $M_1$ 530, the forward predicted pulse $M_2$ 540, and the forward predicted pulse $M_3$ 550, and the backward predicted pulse $M_{-1}$ 560 and the backward predicted pulse $M_{-2}$ 570. That is to say, the process is performed once in the typical forward direction, and after the speech sub-frame 510 is reversed in software, the process is performed once again in the atypical backward direction, yet it employs the same mathematical method, i.e., only the data are reversed with respect to speech sub-frame 510.

Figure 6:
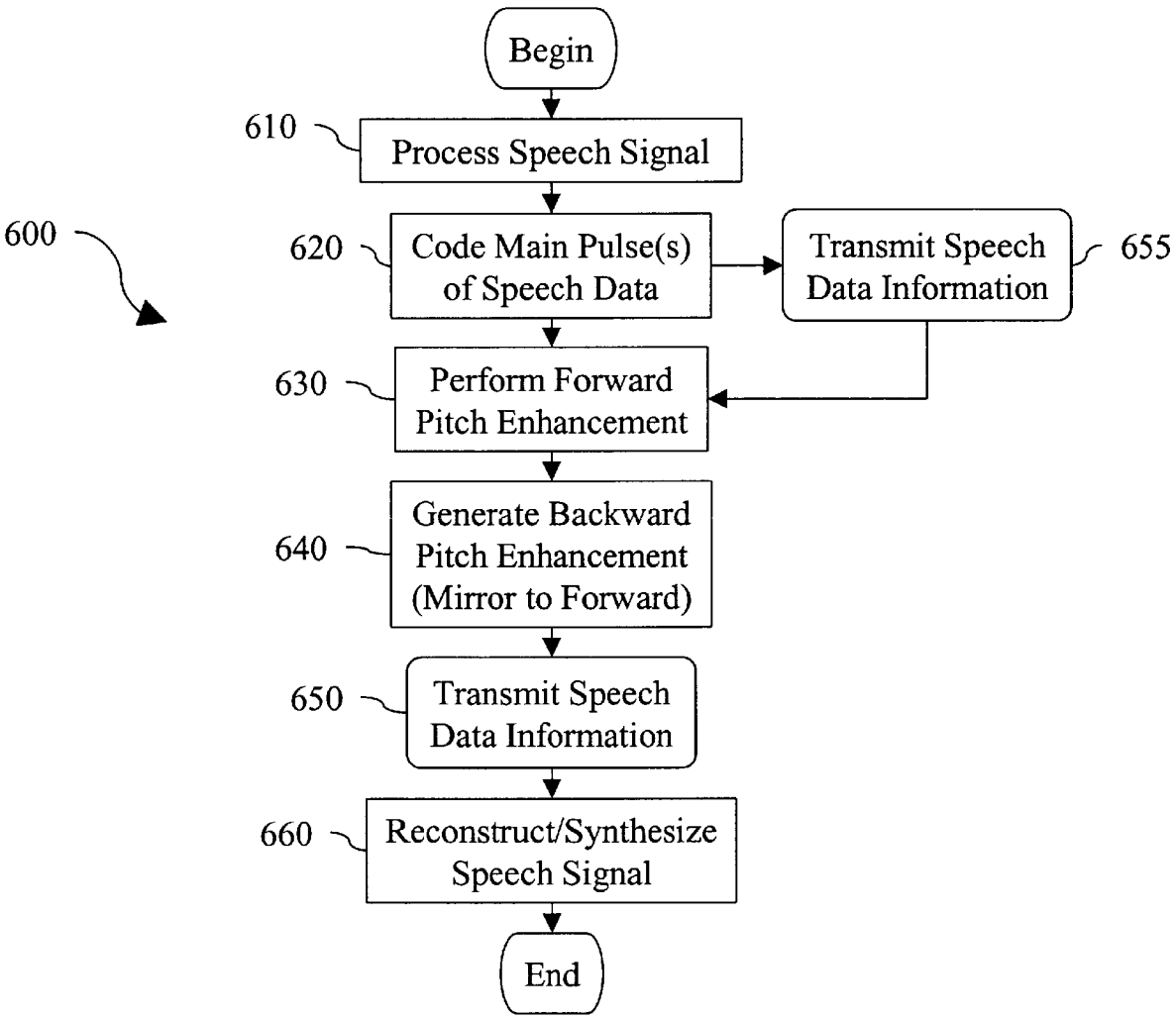
FIG. 6 illustrates a functional block diagram illustrating an embodiment of the present invention that generates backward speech pitch enhancement using forward speech pitch enhancement in accordance with the present invention.

FIG. 6 illustrates a functional block diagram illustrating an embodiment 600 of the present invention that generates backward speech pitch enhancement using forward speech pitch enhancement in accordance with the present invention. In a block 610, a speech signal is processed. In a block 620, a main pulse of the speech data is coded. In an alternative process block 655, the speech data information is transmitted via a communication link. The alternative process block 655 is employed in embodiments of the invention wherein the forward pitch enhancement and backward pitch enhancement are performed after the coded speech data is transmitted for speech reproduction. In a block 630, forward pitch enhancement is performed, and in a block 640, backward pitch enhancement is performed. The backward pitch enhancement of the block 640 is a mirror image of the forward pitch enhancement that is generated in the block 630 in certain embodiments of the invention. In other embodiments, the backward pitch enhancement of the block 640 is not a mirror image of the forward pitch enhancement that is generated in the block 630. In an alternative process block 650, the speech data information is transmitted via a communication link. The alternative process block 650 is employed in embodiments of the invention wherein the forward pitch enhancement and backward pitch enhancement are performed prior to the coded speech data being transmitted for speech reproduction. In a block 660, the speech signal is reconstructed/synthesized.

In certain embodiments of the invention, the backward pitch enhancement performed in the block 640 is simply a duplicate of the forward pitch enhancement performed in the block 650, i.e., backward pitch enhancement of the block 640 is a mirror image of the forward pitch enhancement generated in the block 630. For example, after the forward pitch enhancement is performed in the block 650, the resultant pitch enhancement is simply copied and reversed within a speech sub-frame to generate the backward pitch enhancement performed in the block 640 using any method known to those skilled in the art of speech processing for synthesizing and reproducing a speech signal.

Figure 7:
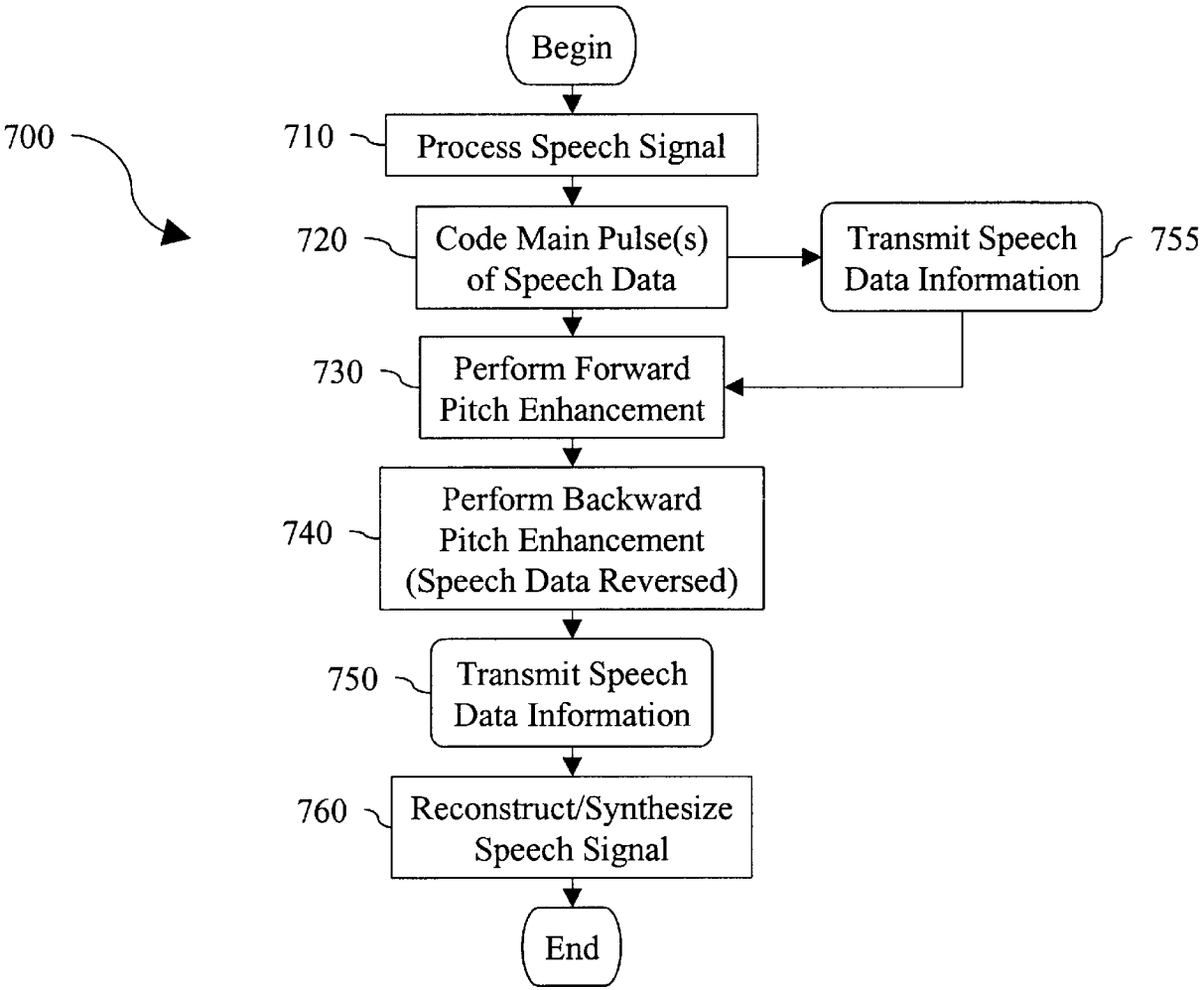
FIG. 7 illustrates a functional block diagram illustrating an embodiment of the present invention that performs backward speech pitch enhancement independent of forward speech pitch enhancement in accordance with the present invention.

FIG. 7 illustrates a functional block diagram illustrating an embodiment 700 of the present invention that performs backward speech pitch enhancement independent of forward speech pitch enhancement in accordance with the present invention. In a block 710, a speech signal is processed. In a block 720, a main pulse of the speech data is coded. In an alternative process block 755, the speech data information is transmitted via a communication link. The alternative process block 755 is employed in embodiments of the invention wherein the forward pitch enhancement and backward itch enhancement are performed after the coded speech data is transmitted for speech et- reproduction. In a block 730, forward pitch enhancement is performed, and in a block 740, backward pitch enhancement is performed. The backward pitch enhancement of the block 740 is performed after the speech data is reversed; the backward pitch enhancement of the block 740 is performed independently of the forward pitch enhancement that is performed in the block 730. This particular embodiment differs from that illustrated in the embodiment 600, in that, the speech data are reversed and the backward pitch enhancement of the block 740 is generated as if an entirely new set of speech data were being processed. Conversely, in the embodiment 600, the resulting pitch enhancement itself is utilized, but it extended in the reverse direction. In certain embodiments of the embodiment 700, it is as if two sets of speech data are being processed for each sub-frame; one set of data is processed to generate the pitch prediction in the forward direction in the block 730, and one set of data is processed to generate the pitch prediction in the backward direction in the block 740, yet they are both operating on the same sub-frame of speech data. In an alternative process block 750, the speech data information is transmitted via a communication link. The alternative process block 750 is employed in embodiments of the invention wherein the forward pitch enhancement of the block 730 and backward pitch enhancement of the block 740 are performed prior to the coded speech data being transmitted for speech reproduction. In a block 760, the speech signal is reconstructed/synthesized.

In view of the above detailed description of the present invention and associated drawings, other modifications and variations will now become apparent to those skilled in the art. It should also be apparent that such other modifications and variations may be effected without departing from the spirit and scope of the present invention.

What is claimed is:

1. A code-excited linear prediction (CELP) speech codec that performs pitch enhancement on excitation signals, the speech codec comprising:

a main pulse coding module configured to place at least one main pulse in a speech subframe;

a forward pitch enhancement circuit contained within the speech codec, the forward pitch enhancement circuit operating on the speech sub-frame, the forward pitch enhancement circuit further configured to place at least one forward predicted pulse within the speech sub-frame; and a backward pitch enhancement circuit contained within the speech codec, the backward pitch enhancement circuit operating on the speech sub-frame, the backward pitch enhancement circuit further configured to place at least one backward predicted pulse within the speech sub-frame.

2. The speech codec of claim 1, wherein the forward pitch enhancement circuit and the backward pitch enhancement circuit operate cooperatively to improve the perceptual quality of the excitation signals for reproduction.

3. The speech codec of claim 1, wherein the forward pitch enhancement circuit and the backward pitch enhancement circuit operate independently to improve the perceptual quality of the excitation signals for reproduction.

4. The speech codec of claim 1, wherein each of the predicted pulses has a lower gain than the main pulse.

5. The speech codec of claim 1, wherein the backward predicted pulses and the forward predicted pulses are generated using the main pulse.

6. The speech codec of claim 1, wherein the backward predicted pulses are generated using the forward predicted pulses.

7. A code-excited linear prediction (CELP) speech codec that performs pitch enhancement on excitation signals, the speech codec comprising:

an encoder configured to place at least one main pulse in a speech subframe;

a communication link communicatively coupled to the encoder;

a decoder communicatively coupled to the encoder via the communication link;

a forward pitch enhancement circuit contained within the speech codec, the forward pitch enhancement circuit operating on the speech sub-frame, the forward pitch enhancement circuit further configured to place at least one forward predicted pulse within the speech sub-frame; and a backward pitch enhancement circuit contained within the speech codec, the backward pitch enhancement circuit operating on the speech sub-frame, the backward pitch enhancement circuit further configured to place at least one backward predicted pulse within the speech sub-frame.

8. The speech codec of claim 7, wherein the forward pitch enhancement circuit and the backward pitch enhancement circuit operate cooperatively to improve the perceptual quality of the excitation signal for reproduction.

9. The speech codec of claim 7, wherein the forward pitch enhancement circuit and the backward pitch enhancement circuit operate independently to improve the perceptual quality of the excitation signal for reproduction.

10. A code-excited linear prediction (CELP) speech pitch enhancement system that operates on excitation signals, the speech pitch enhancement system comprising:

a main pulse coding module configured to place at least one main pulse in a speech subframe; and a backward pitch enhancement circuit configured to operate on the speech sub-frame, the backward pitch enhancement circuit further configured to place at least one backward predicted pulse within the speech sub-frame.

11. The speech pitch enhancement system of claim 10, further comprising a forward pitch enhancement circuit communicatively coupled to the backward pitch enhancement circuit, the forward pitch enhancement circuit operating on the speech sub-frame, the forward pitch enhancement circuit further configured to place at least one forward predicted pulse within the speech sub-frame.

12. The speech pitch enhancement system of claim 11, wherein the forward pitch enhancement circuit and the backward pitch enhancement circuit operate cooperatively to improve the perceptual quality of the excitation signals for reproduction.

13. The speech pitch enhancement system of claim 11, wherein the forward pitch enhancement circuit and the backward pitch enhancement circuit operate independently to improve the perceptual quality of the excitation signals for reproduction.

14. A code-excited linear prediction (CELP) pitch enhancement system that operates on excitation signals, the speech pitch enhancement system comprising:

a main pulse coding module configured to place at least one main pulse in a speech subframe; and a backward pitch enhancement circuit configured to operate on the speech sub-frame, the backward pitch enhancement circuit further configured to place at least one backward predicted pulse within the speech sub-frame, the backward pitch enhancement circuit being distributed between the encoder and the decoder; and a speech processing circuit communicatively coupled to the backward pitch enhancement circuit, the speech processing circuit configured to manipulate excitation signals.

15. The speech pitch enhancement system of claim 14, further comprising a forward pitch enhancement circuit communicatively coupled to the backward pitch enhancement circuit, the forward pitch enhancement circuit operating on the speech sub-frame, the forward pitch enhancement circuit further configured to place at least one forward predicted pulse within the speech sub-frame.

16. The speech pitch enhancement system of claim 15, wherein the forward pitch enhancement circuit and the backward pitch enhancement circuit operate cooperatively to improve the perceptual quality of the excitation signals for reproduction.

17. The speech pitch enhancement system of claim 15, wherein the forward pitch enhancement circuit and the backward pitch enhancement circuit operate independently to improve the perceptual quality of the excitation signals for reproduction.

18. A code-excited linear prediction (CELP) method that performs speech pitch enhancement on an excitation signal, the method comprising:

placing at least one main pulse in a speech subframe; and performing forward pitch enhancement on the excitation signal by placing at least one forward predicted pulse within the speech sub-frame; and performing backward pitch enhancement on the excitation signal by placing at least one backward predicted pulse within the speech sub-frame.

19. The method of claim 18, wherein the performing forward pitch enhancement on the excitation signal and the performing backward pitch enhancement on the excitation signal are performed cooperatively to improve the perceptual quality of the excitation signal for reproduction.

20. The method of claim 18, wherein the performing forward pitch enhancement on the excitation signal and the performing backward pitch enhancement on the excitation signal are performed using a speech codec.

21. The method of claim 18, wherein each of the predicted pulses has a lower gain than the main pulse.

22. The method of claim 18, wherein the backward predicted pulses are generated using the forward predicted pulses.

23. The method of claim 18, wherein the backward predicted pulses and the forward predicted pulses are generated using the main pulse.

* * * * *